United States Patent [19]

Ostrowsky et al.

[11] Patent Number: 4,887,747

[45] Date of Patent: Dec. 19, 1989

[54] TWO-PIECE, SNAP-ACTION CLOSURE

[75] Inventors: Efrem M. Ostrowsky, Highland Park; John P. Kinsley, Crystal Lake, both of Ill.

[73] Assignee: Seaquist Closures, a division of Pittway Corporation, Crystal Lake, Ill.

[21] Appl. No.: 204,166

[22] Filed: Jun. 8, 1988

[51] Int. Cl.[4] ..... B65D 47/08

[52] U.S. Cl. ..... 222/556; 222/498; 222/517; 220/335; 220/338

[58] Field of Search ..... 222/498, 517, 556, 499; 220/335, 338

[56] References Cited

U.S. PATENT DOCUMENTS

| | | | |
|---|---|---|---|
| 30,861 | 2/1982 | Krawagna . | |
| 673,000 | 4/1901 | Dyer . | |
| 1,166,551 | 1/1916 | Simmons . | |
| 2,304,223 | 12/1942 | Westrope . | |
| 2,342,477 | 2/1944 | Magnenat | 220/338 |
| 2,833,447 | 12/1956 | Thiece | 222/556 X |
| 2,889,087 | 8/1956 | Paull et al. | 222/498 |
| 3,120,879 | 2/1964 | Warner . | |
| 3,752,371 | 8/1973 | Susuki et al. . | |
| 3,933,271 | 1/1976 | McGhie . | |
| 4,158,902 | 6/1979 | Chernack et al. . | |
| 4,220,248 | 9/1980 | Wilson et al. . | |
| 4,278,179 | 7/1981 | McWilliams . | |
| 4,291,818 | 9/1981 | Nozawa et al. . | |
| 4,343,397 | 8/1982 | Nozawa et al. . | |
| 4,377,247 | 3/1983 | Hazard et al. . | |
| 4,399,928 | 8/1983 | Klingler . | |
| 4,403,712 | 9/1983 | Wiesinger . | |
| 4,441,637 | 4/1984 | Libit . | |
| 4,615,462 | 10/1986 | Sacherer et al. . | |
| 4,625,898 | 12/1986 | Hazard . | |
| 4,666,068 | 5/1987 | Bush | 220/338 X |
| 4,742,928 | 5/1988 | Braun | 220/338 X |

FOREIGN PATENT DOCUMENTS

| | | | |
|---|---|---|---|
| 449737 | 6/1949 | Italy | 222/517 |

OTHER PUBLICATIONS

"CC-2 Engineering Data and Features", (1 sheet, Sunbeam Plastics Corp.).

*Primary Examiner*—Joseph J. Rolla
*Assistant Examiner*—Boris Milef
*Attorney, Agent, or Firm*—Dressler, Goldsmith, Shore, Sutker & Milnamow

[57] ABSTRACT

A container closure is provided with a structure that permits it to be readily disassembled and assembled for use on a container defining an opening communicating with the container interior. The closure includes a body and a cover separate from the body. The cover is adapted to be pivoted about an axis between a closed position occluding a dispensing orifice in the body and at least one open position spaced away from the dispensing orifice. An axis-defining structure is provided on either the cover or the body for defining the pivot axis of the closure, and also includes a cam surface around the axis. The other one of the cover or body is provided with a receiving structure for engaging the cam surface to mount the cover to the body for pivoting about the axis. Either or both of the cover and body is elastically deformable. The deformable structure is least stressed when the cover is at one of the open positions. The deformable structure is most stressed when the cover is at over center point between the open and closed positions.

9 Claims, 3 Drawing Sheets

FIG. 1
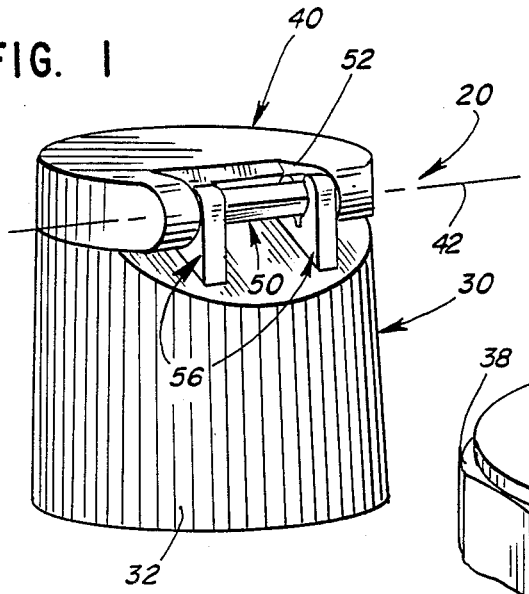
FIG. 2
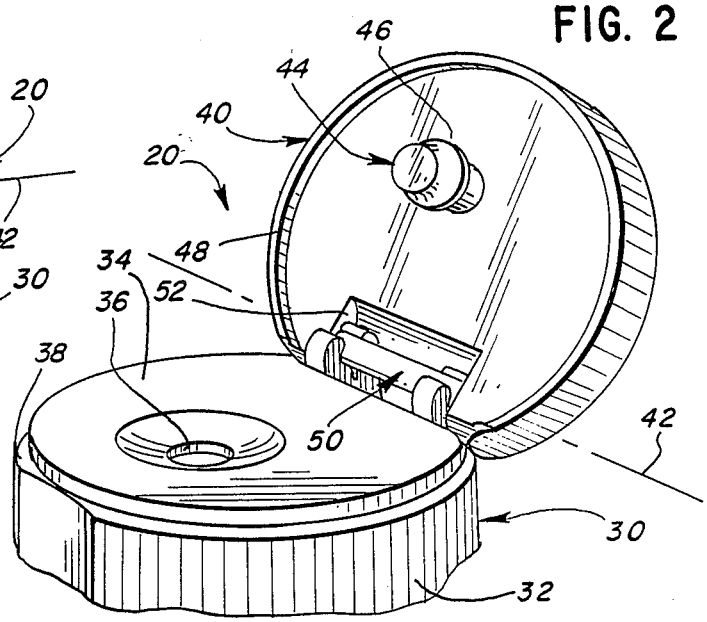
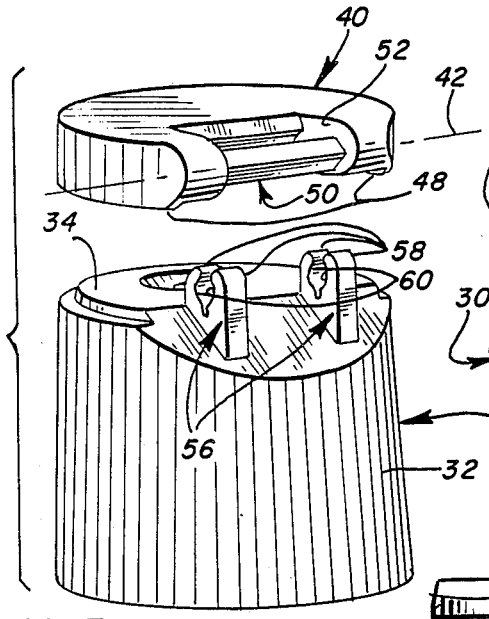
FIG. 3
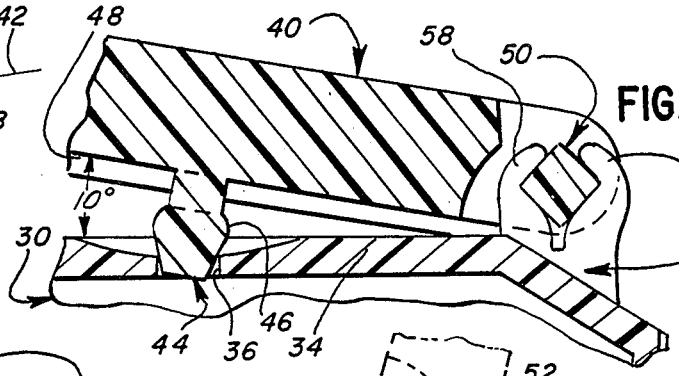
FIG. 6
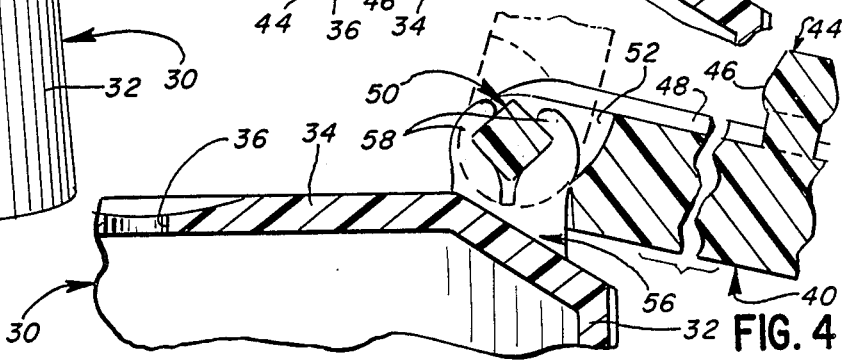
FIG. 4
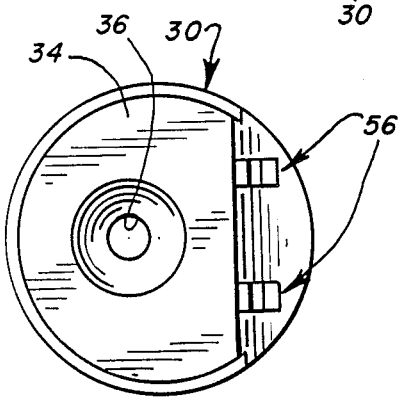
FIG. 7
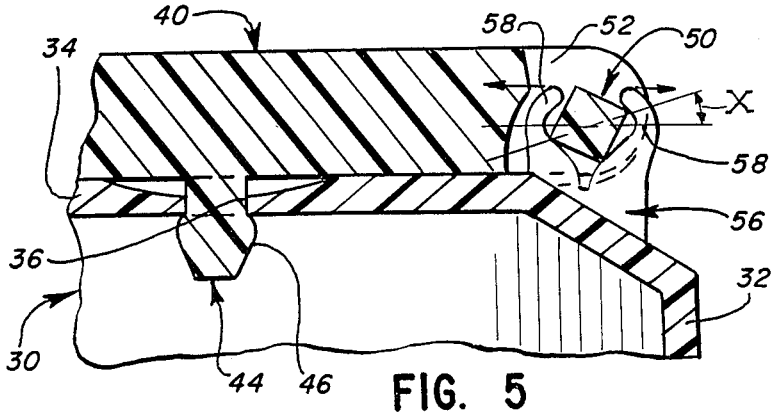
FIG. 5

FIG. 8
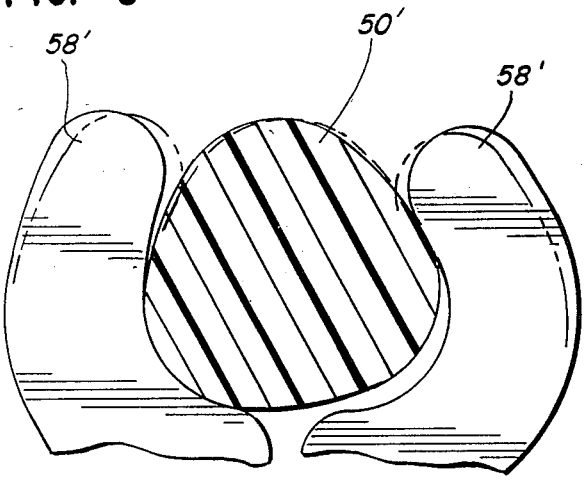
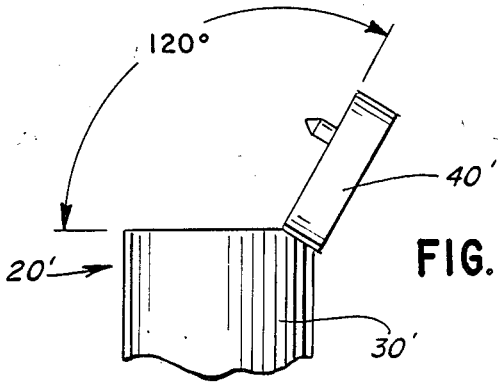
FIG. 9
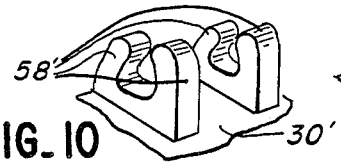
FIG. 10
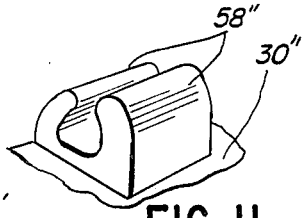
FIG. 11
FIG. 12
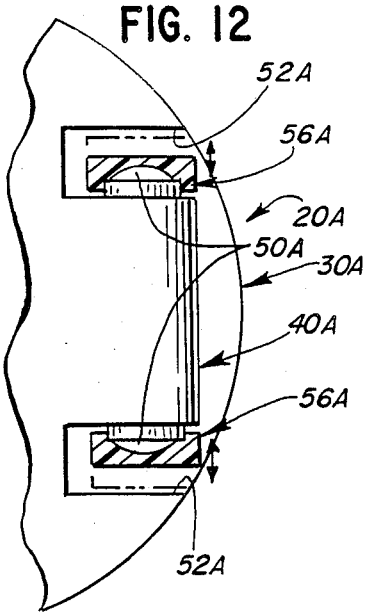
FIG. 14
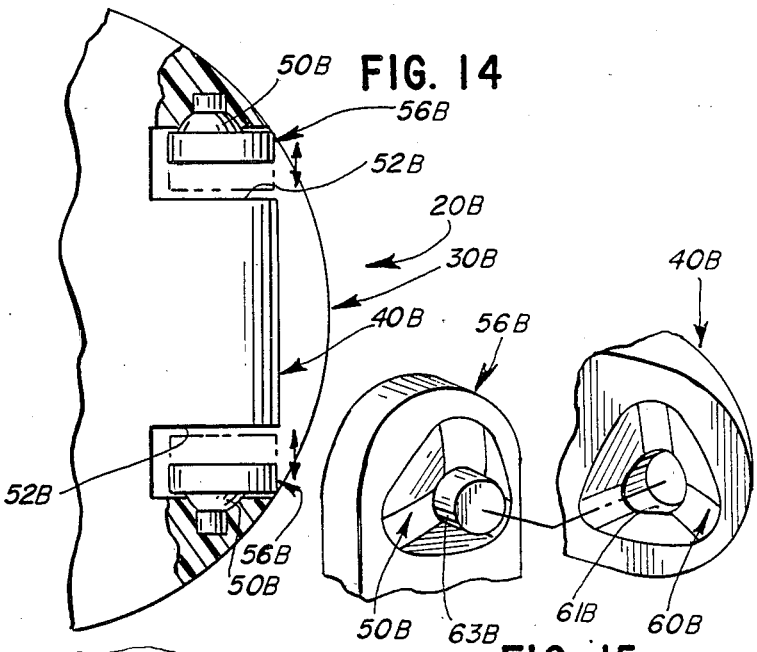
FIG. 15
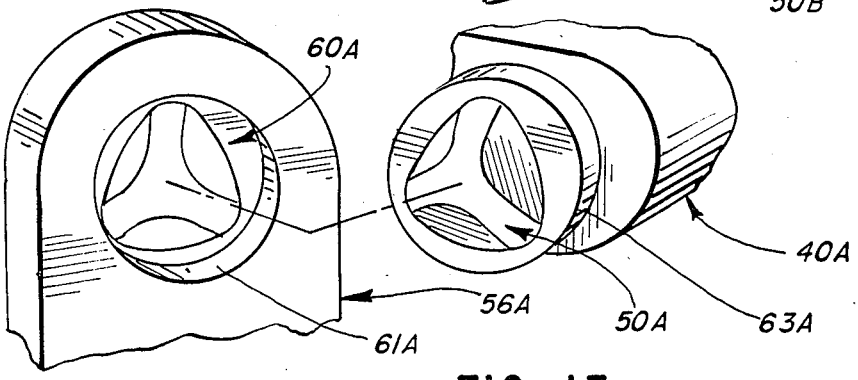
FIG. 13

FIG. 18A
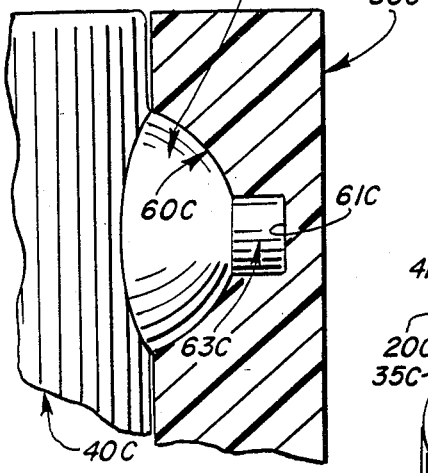
FIG. 16
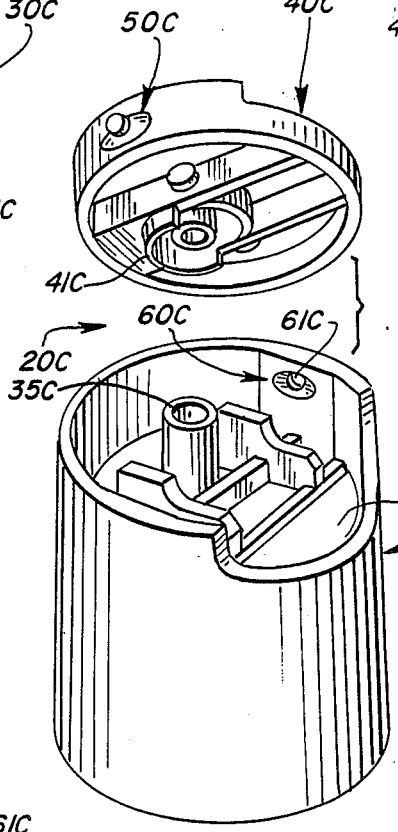
FIG. 17A
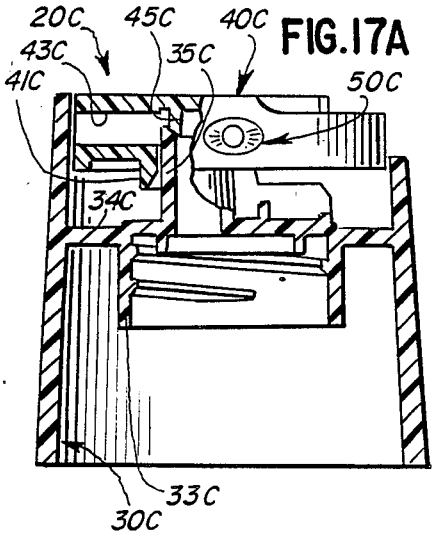
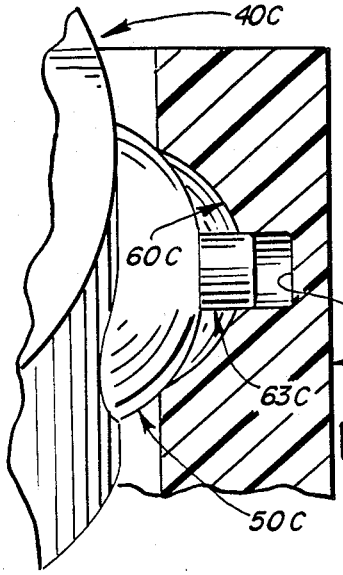
FIG. 18B
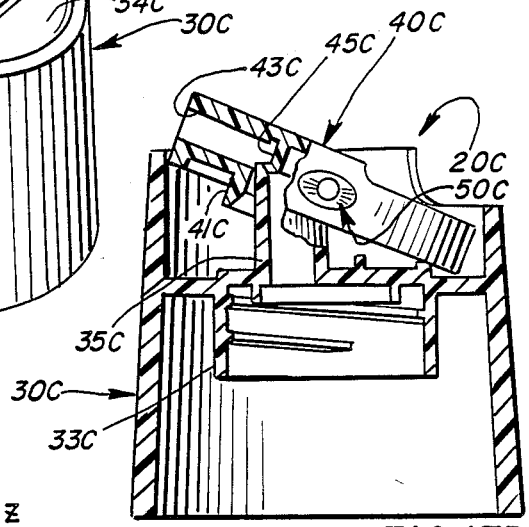
FIG. 17B
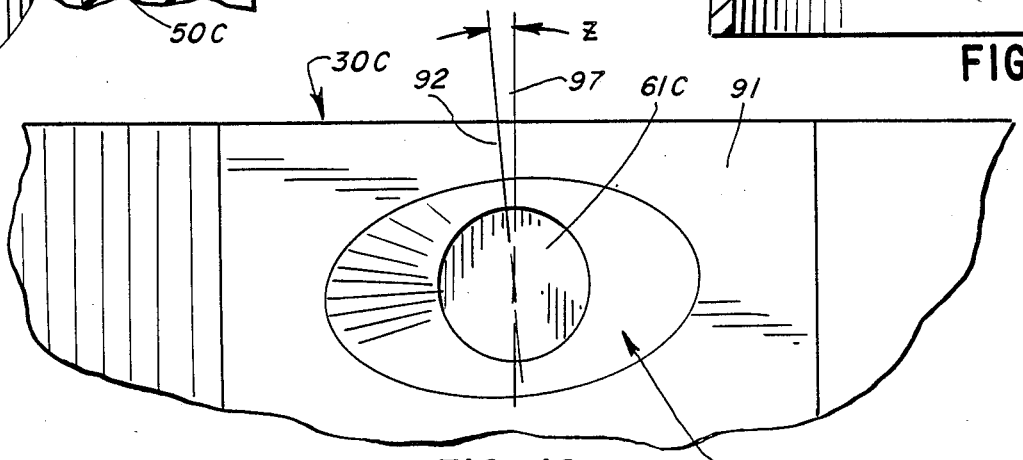
FIG. 19

TWO-PIECE, SNAP-ACTION CLOSURE

TECHNICAL FIELD

This invention relates to a dispensing closure for a container, and more particularly to a two-piece dispensing closure.

BACKGROUND OF THE INVENTION AND TECHNICAL PROBLEMS POSED BY THE PRIOR ART

There are a wide variety of dispensing closures which are provided with a dispensing orifice in a closure body to which a lid or cover is hinged for pivoting movement between an open position spaced away from the dispensing orifice and a closed position occluding the dispensing orifice. Many such conventional closures are unitary structures in which the closure cover is joined to the closure body with a hinge, and such structures are typically molded from thermoplastic materials in one piece. Such one-piece closures may be provided with a snap-action hinge or other means for biasing the cover to an open position on one side of an over center point and to a closed position on the other side of the over center point. U.S. Pat. No. 4,625,898 discloses examples of such one-piece closures.

Another type of conventional closure is fabricated from two pieces, a cover piece and a body piece. Two-piece closures offer the advantages of less complex molds and molding procedures, disassembly capability for ease of cleaning, and the capability for molding the body and cover in different colors. U.S. Pat. No. 4,666,068 discloses a two-piece closure.

It would be desirable to provide an improved two-piece closure wherein the cover has a self-maintained open position and a latched closed position. This would facilitate use of the closure.

Further, it would be desirable if such an improved two-piece closure had the capability for being arranged to provide a biasing force on the cover when the cover is in the latched in the closed position. Then, when the cover is opened, the biasing force would assist in the opening process.

It would also be beneficial if an improved two-piece closure could be provided with the capability for accommodating a plurality of open positions to afford greater or lesser access to the dispensing orifice region as may be desired.

SUMMARY OF THE INVENTION

A container closure is provided in two-pieces which can be readily assembled and disassembled. The closure is adapted for use on a container defining an opening communicating with the container interior.

The closure has a body for being mounted to the container over the container opening and for defining a dispensing orifice for communicating through the container opening with the container interior.

The closure includes a cover separate from the body and disposed on the body for being pivoted about an axis between a closed position occluding the dispensing orifice and an open position spaced away from the dispensing orifice.

The closure includes an axis-defining means or structure on one of the cover and body for defining the axis and having a cam surface around the axis.

An elastically deformable receiving means or structure is provided on the other of the cover and body for engaging the cam surface to mount the cover to the body for pivoting about the axis. The deformable receiving means or structure is most stressed when the cover is at an over center point between the open and closed positions to thereby bias the cover toward one of the open and closed positions.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a perspective view of a first embodiment of the closure of the present invention;

FIG. 2 is a greatly enlarged, fragmentary, perspective view of the first embodiment of the closure of the present invention with the cover shown in the open position;

FIG. 3 is an exploded, perspective view of the first embodiment of the closure;

FIG. 4 is a greatly enlarged, fragmentary, cross-sectional view showing the first embodiment of the closure cover in a first open position in solid lines and in a second open position in dashed lines;

FIG. 5 is a view similar to FIG. 4 but showing the cover latched to the body in the closed position;

FIG. 6 is a view similar to FIG. 5 but showing the cover in a stable, unlatched position;

FIG. 7 is a top plan view of the first embodiment of the closure body;

FIG. 8 is a greatly enlarged, fragmentary, cross-sectional view of the cover shaft and shaft-receiving fingers in a second embodiment of the present invention.

FIG. 9 is a fragmentary, elevation view of the second embodiment of the closure of the present invention showing the cover in the open position;

FIG. 10 is a fragmentary, perspective view of the shaft-receiving fingers on the body of the second embodiment of the closure of the present invention;

FIG. 11 is a fragmentary, perspective view of the shaft-receiving fingers on the body of a third embodiment of the closure of the present invention;

FIG. 12 is a fragmentary, top plan view, partially in section, of a fourth embodiment of the closure of the present invention.

FIG. 13 is a greatly enlarged, fragmentary, exploded, perspective view of the cover cam surface and body receiving cavity of the fourth embodiment of the closure of the present invention;

FIG. 14 is a view similar to FIG. 12, but showing a fifth embodiment of the closure of the present invention;

FIG. 15 is a greatly enlarged, fragmentary, exploded, perspective view of the body cam surface and cover receiving cavity of the fifth embodiment of the closure of the present invention;

FIG. 16 is an exploded, perspective view of a sixth embodiment of the closure of the present invention;

FIG. 17A is an enlarged, cross-sectional view of the sixth embodiment of the closure of the present invention with the nozzle in the closed position;

FIG. 17B is a view similar to FIG. 17A, but showing the nozzle in the open, dispensing position;

FIG. 18A is a greatly enlarged, fragmentary, partial cross-sectional view of the sixth embodiment of the closure of the present invention showing the engagement of the nozzle convex cam surface with the receiving cavity in the body;

FIG. 18B is a view similar to FIG. 18A but showing the convex cam surface in a rotated position relative to the receiving cavity; and FIG. 19 is a greatly enlarged elevational view of the receiving cavity in the wall of the body of the sixth embodiment of the closure of the present invention.

DESCRIPTION OF THE PREFERRED EMBODIMENTS

While this invention is susceptible of embodiment in many different forms, this specification and the accompanying drawings disclose only some specific forms as examples of the use of the invention. The invention is not intended to be limited to the embodiments so described, and the scope of the invention will be pointed out in the appended claims.

For ease of description, the closure of this invention is described and the normal (upright) operating position, and terms such as upper, lower, horizontal, vertical, etc., are used with reference to this position. It will be understood, however, that the apparatus of this invention may be manufactured, stored, transported, used, and sold in an orientation other than the position described.

With reference to FIG. 1, a first embodiment of the two-piece dispensing closure of the present invention is designated generally by reference numeral 20 and has a cylindrical or slightly frustoconical body 30 for being mounted to a container (not illustrated) over an opening in the mouth of the container which communicates with the container interior. The body 30 includes a skirt 32 which may be provided with internal threads (not illustrated) or snap-on beads (not illustrated) for mating with complementary threads or beads on the container neck (not illustrated).

As best illustrated in FIG. 2, the body 30 includes a transverse cross wall 34 which defines a dispensing orifice 36 for communicating through the container opening with the container interior. The top of the body skirt 32 may be recessed below the top of the closure cross wall 34 to define an annular deck rim 38 around the cross wall 34.

The closure 20 also includes a cover 40 which is separate from the body 30 and which is disposed on the body 30 for being pivoted about an axis 42 between a closed position (FIG. 1) occluding the dispensing orifice 36 and an open position spaced away from the dispensing orifice (FIG. 2).

The cover 40 is preferably formed with a closure plug 44 (FIG. 2) having an enlarged end portion 46. The portion 46 has a slightly larger diameter than the dispensing orifice 36. The region in the transverse cross wall 34 around the dispensing orifice is sufficiently resilient so that as the cover 40 is closed, the enlarged portion 46 of the plug 44 elastically deforms the periphery of the orifice 36 temporarily as the enlarged portion 46 passes through the orifice 36. Then, when the cover 40 is in the fully closed position (FIGS. 1 and 5) the enlarged portion 46 is disposed below the underside of the transverse cross wall 34, and the periphery of the orifice 36 has returned to its original configuration and size to thereby cooperate with the plug 44 for latching the cover 40 in the closed position.

As best illustrated in FIG. 2, the cover 40 is also preferably provided with a downwardly depending, peripheral skirt 48 which is received on the rim 38 around the transverse cross wall 34 when the cover 40 is in the latched closed position.

The cover 40 is mounted to the body 30 with an axis-defining means which may be either on the cover 40 or on the body 30 and which, in the first embodiment illustrated in FIGS. 1–7, is integrally formed as part of the cover 40. In particular, the axis-defining means includes a shaft-like member 50. The member 50 has a generally square-shaped cross section as best illustrated in FIGS. 4–6, but the corners of the square configuration are slightly rounded. The exterior surface of the member 50 may be characterized as a convex exterior cam surface around the pivot axis 42 (FIG. 2) of the cover 40.

The shaft-like member 50 extends across the rear portion of the cover 40 in a notch 52. The member 50 need not necessarily extend across the entire notch 52. For example, the axis-defining means may be two separate shaft-like members extending from opposite sides of the notch 52 along the axis 42 without any middle portion connecting the two members. Also, two notches could be provided—each with a separate shaft-like member.

In any event, the axis-defining, shaft-like member 50 is engaged in an elastically deformable receiving means which, in the first embodiment illustrated in FIGS. 1–7, includes a pair of wall portions or posts 56 which each project upwardly from the body 30 and which each have a pair of fingers 58 (FIG. 3) that define between them a receiving region 60. As best illustrated in FIGS. 3 and 6, the receiving region 60 defined between each pair of fingers 58 has a concave indentation configuration substantially complementary to the exterior cam surface of the shaft-like member 50.

The fingers 58 are elastically deformable or deflectable to accommodate the rotation of the shaft-like member 50 therein about the pivot axis 42. Rotation of the member 50 varies the spacing between the fingers 58 to vary the resistance reaction force on the member 50. When the member 50 is in the orientation as illustrated in FIG. 6, two opposite corners of the cross sectional shape are received in the complementary indentations of the fingers 58. In this position, the fingers 58 are at an innermost orientation in relative to the member 50, and the resistance to rotation of the member 50 about the axis 42 in one direction or the other is greatest. Thus, the cover position illustrated in FIG. 6 can be characterized as a stable or neutral position.

If the cover 40 is rotated in one direction or the other (i.e., moved toward an open position as in FIGS. 2 and 4 or moved toward a latched closed position as illustrated in FIG. 5), then the fingers 58 are urged to spread apart (e.g., as illustrated in FIG. 5). As the fingers 58 are spread apart, they are subjected to greater stress. The rotation of the shaft-like member 50 creates a sufficient temporary deformation of the fingers 58 so that the cover 40 can be rotated toward a desired orientation so long as force is continuously applied to the cover 40. However, if the opening or closing force is removed from the cover 40, the deformation-induced stress in the fingers 58 is sufficient to automatically move the cover 40 toward the next closest stable position.

In the first embodiment illustrated in FIGS. 1–7, the cover 40 has four theoretically possible stable positions since the member 50 has four orientations in which it could be nestably received between the fingers 58. However, only three of the four theoretical stable positions can be occupied by the cover 40 owing to the interference of the closure body 30. One of the stable positions of the cover 40 is illustrated in solid lines in FIG. 4, a second stable position of the cover 40 is illustrated in dashed lines in FIG. 4, and a third stable position of the cover 40 is illustrated in solid lines in FIG. 6.

The stable position illustrated in FIG. 6 is a position in which the cover 40 partially, but not fully, closes the dispensing orifice 40. This position is a self-maintained unlatched position between the closed position and an over center point.

To fully close the cover 40, the cover 40 must be pushed downwardly to latch the plug 44 with the transverse wall 34 of the closure body 30. As best illustrated in FIG. 5, the full, latched closed position is reached when the cover shaft-like member 50 has been rotated through an angle X from its unlatched, stable position in FIG. 6. The fingers 58 are more stressed when the cover 40 is in the latched closed position (FIG. 5). Thus, the fingers 58 apply a biasing force to the cover 40 so as to urge the cover 50 up towards the unlatched stable position illustrated in FIG. 6. The biasing force of the fingers 58 is insufficient, however, to overcome the snap-fit interlock between the cover plug 44 and the body cross wall 34.

It is only when the cover 40 is forced open by lifting up on an exterior portion of the cover 40 with sufficient force that the snap-fit interlock is overcome. At that point, the biasing force of the fingers 58 functions to help pivot the cover 40 to the unlatched stable position illustrated in FIG. 6. The cover 40 can be opened further by continuing to apply an opening force to the cover 40 so that the cover 40 moves to the next (intermediate) stable open position illustrated in dashed lines FIG. 4 or to the full open position illustrated in solid lines in FIG. 4.

A second embodiment of the closure of the present invention is illustrated in FIG. 8–10 and is designated in FIG. 9 generally by the reference numeral 20'. The closure has a body 30' and a pivotable cover 40'.

The cover 40' has in axis-defining means in the form of a shaft-like member 50' similar to the member 50 of the first embodiment discussed above with reference to FIG. 1–7. However, the second embodiment member 50' has a generally triangular cross-sectional configuration rather than a square-shaped cross-sectional configuration. The corners of the triangular configuration are generally rounded. The member 50' is received in complementary fingers 58' on the closure body 30'. The combination of the member 50' and the fingers 58' provides three stable rotated positions.

The pairs of fingers 58' may be spaced apart on the closure body 30' as illustrated in FIG. 10 in a manner similar to that of the fingers 58 in the first embodiment discussed above with reference to FIGS. 1–7. Although the pairs receiving fingers 58' for the second embodiment and fingers 58 for the first embodiment have been illustrated and described as being spaced apart on the closure body, it is to be realized that a single pair of fingers may be provided as illustrated in FIG. 11 for a third embodiment of the invention wherein the fingers are designated generally by the reference numerals 58'' and project up from a closure body 30''.

FIGS. 12 and 13 illustrate a fourth embodiment of the closure of the present invention wherein the closure is designated generally by the reference numeral 20A. The closure 20A includes a body 30A with a pair of spaced-apart posts or wall portions 56A projecting upwardly from the closure body 30A. Each wall portion 58A is elastically deformable and has a receiving surface defining a cavity 60A (FIG. 13). Each cavity 60A faces toward the other cavity 60A. Each cavity 60A has an opening configuration generally in the shape of a tetrahedron with a rounded vertex and rounded edges. Further, each wall portion 56A includes a cylindrical journal bearing 61A around the opening of the cavity 60A.

The closure 20A includes a cover 40A with a pair of spaced-apart notches 52A. Projecting into each notch 52A is a convex cam surface 50A. Each cam surface is oriented to face away from the other cam surface 50A. Each convex cam surface 50A has a configuration generally in the shape of a tetrahedron with a rounded vertex and rounded edges substantially complementary to the configuration of the cavities 60A and is adapted to be received in one of the cavities 60A.

Preferably, the cover 40A also includes a cylindrical projection 63A at the base of each cam surface 50A for being disposed within one of the cylindrical journal bearings 61A. This defines the axis of rotation of the cover 40A.

The deformable wall portions 56A are most stressed when the cover 40A is moved to an over center point between an open position and the closed position. This biases is a cover 40A toward one or the other of the open and closed positions.

In operation, when the cover 40A is pivoted, the convex cam surfaces 50A impose a force on the receiving surface of the receiving cavities 60A. This causes the wall portions 56A to spread apart (to the moved positions illustrated in dashed lines in FIG. 12) to accommodate the rotation.

It is to be understood that the locations of the convex cam surfaces 50A and associated cylindrical projections 63A may be reversed relative to the cavities 60A and associated internal bearings 61A. In particular, the convex cam surfaces 50A and cylindrical projections 63A may be molded as a unitary part of the closure body posts 56A while the receiving cavities 60A and associated journal bearings 61A may be molded as a unitary part of the cover 40A.

FIGS. 14 and 15 illustrate a fifth embodiment of the closure of the present invention wherein the fifth embodiment is designated generally by the reference numeral 20B. The fifth embodiment is similar to the fourth embodiment described above with reference to FIGS. 12 and 13 in that the fifth embodiment includes a closure body 30B and a cover 40B having a pair a spaced-apart notches 52B for receiving elastically deformable wall portions or posts 56B which project upwardly from the closure body 30B.

Each deformable wall portion 56B defines a convex cam surface 50B around the pivot axis. Each cam surface 50B is oriented to face away from the other cam surface. Each cam surface 50B has a configuration generally in the shape of a tetrahedron with a rounded vertex and rounded edges as best illustrated in FIG. 15. A generally cylindrical projection 63B extends outwardly from each cam surface 50B.

The cover 40A has two spaced-apart receiving surfaces which each define a cavity 60B generally in the shape of a tetrahedron with a rounded vertex and rounded edges. The shape of each cavity 60B is generally complementary to the shape of each of the cam surfaces 50B. The cavities 60B are oriented to face each other.

As best illustrated in FIG. 15, the cover 40B includes a cylindrical journal bearing 61B at the bottom of each cavity 60B. The journal bearings 61B receive the cylindrical projections 63B to establish a fixed pivot axis for the cover 40B.

When the cover 40B is pivoted relative to the closure body 30B, the cam surfaces 50B cause the closure body posts 56B to deflect inwardly (to the positions illustrated in dashed lines in FIG. 14). This accommodates the rotation of the cover 40B to the desired position. The increased stress on the inwardly deflected posts 56B imposes a reaction force on the cover cam surfaces 50B which tends to bias the cover 40B toward one of the three stable positions defined by the cooperating tetrahedron cam surfaces 50B and receiving cavities 60B.

With respect to the fifth embodiment illustrated in FIGS. 14 and 15, it is to be realized that the configuration of the cam surfaces 50B and receiving cavities 60B could be reversed. Specifically, the cam surfaces 50B could be incorporated on the cover 40B, and the receiving cavities 60B could be incorporated in the closure body post 56B.

FIGS. 16–19 illustrate a sixth embodiment of the closure of the present invention wherein the sixth embodiment is designated generally by the reference numeral 20C. The general configuration of the closure 20C is that of the conventional flip-up spout or nozzle type. Closures of this type are generally disclosed in the U.S. Pat. Nos. 3,516,581 and 4,645,086.

As best illustrated in FIGS. 16 and 17A, the closure 20C includes a body 30C for securement to a container (not illustrated). The body includes a transverse cross wall 34C which is penetrated by a discharge tube 35C that defines a dispensing orifice.

The closure body 30C may have a reduced diameter peripheral wall 33C as illustrated in FIG. 17A. The wall 33C is adapted to engage the outer periphery of the top of the container with threads or other suitable engaging means.

A cover or nozzle assembly 40C is adapted to be received on the body 30C. As best illustrated in FIG. 17B, the cover 40C includes a downwardly depending flange 41C which defines an inlet guide to a nozzle or channel 43C within the cover 40C. The container contents can be discharged when the cover 40C is in the open position (as illustrated in FIG. 17B) through the nozzle channel 43C. When the cover is closed (as illustrated in FIG. 17A), flow through the nozzle channel 43C is blocked by the engagement of the body discharge tube 35C with an occluding annular plug 45C in the cover 40C.

A novel structure is incorporated in the closure 20C for providing the cover 40C with a capability for being self-maintained in the open or closed positions. To this end, two spaced-apart wall portions of the closure body 30C each define a cavity 60C with an opening configuration generally in the shape of a partial ellipsoid (as best seen in FIG. 19). Each cavity 60C is oriented to face the other cavity.

The closure body 30C also includes a cylindrical journal bearing 61C at the bottom of each of the cavities 60C.

The cover 40C includes two spaced-apart convex cam surfaces 50C. Each cam surface 50C is oriented to face away from the other convex cam surface. Each cam surface 50C has a configuration generally in the shape of a partial ellipsoid which is substantially complementary to the configuration of the cavities 60C. Each cavity 60C is adapted to receive one of the cam surfaces 50C.

The cover 40C also includes a cylindrical projection 63C extending outwardly from each of the convex cam surfaces 50C for being disposed within one of the cylindrical journal bearings 61C as best illustrated in FIG. 18A.

One or the other of the closure body 30C and cover 40C may be elastically deformable, at least in the regions of the cam surfaces 50C and receiving cavities 60C. Alternatively, both the body and cover may be elastically deformable, at least in the regions of the cam surfaces 50C and receiving cavities 60C. FIG. 18B illustrates a substantially rigid body 30C and an elastically deformable cover 40C. As the cover 40C is pivoted relative to the closure body 30C, the sides of the cover 40C are deflected inwardly as each convex cam surface 50C is forced inwardly by the surface of the associated receiving cavity 60C.

The deformable regions are most stressed when the cover 40C is at an over center point where the contours of the ellipsoid cam surface 50C and of the ellipsoid receiving cavity 60C are most mismatched during movement of the cover 40C. The increased stress on the cover 40C imposes a biasing force which tends to urge the cover 40C in one direction of rotation or the other until the cam surface 50C again matches the surface of the receiving cavity 60C in a nesting relationship (FIG. 18). When the cam surface 50C is nestably received in the cavity 60C as illustrated in FIG. 18A, the cover 40C is characterized as being in a stable position.

FIG. 19 illustrates the ellipsoid configuration of the cavity 60C as having mutually orthogonal major and minor axes 91 and 92, respectively. The cavity 60C is oriented at an oblique angle Z relative to the vertical axis 97 of the closure. In contrast, and as best illustrated in FIG. 17A, the cam surfaces 50C do not have such an orientation. Instead, the ellipsoid configuration of each cam surface 50C is oriented so that its minor axis is generally aligned with the vertical axis of the closure. Thus, when the closure 40C is in the closed position, the closure 40C will be under a continuous biasing force to urge cover 40C into tight sealing engagement with the body 30C.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A container closure which can be readily disassembled and assembled for use on a container defining an opening communicating with the container interior, said closure comprising:

a body for being mounted to said container over said container opening and defining a dispensing orifice for communicating through said container opening with said container interior;

a cover separate from said body and disposed on said body for being pivoted about an axis between a closed position occluding said dispensing orifice and an open position spaced away from said dispensing orifice;

a shaft defining said axis on one of said cover and body, said shaft having a generally square axial cross section defining corners on said shaft; and a pair of spaced-apart fingers projecting from the other of said cover and body, said fingers of each pair defining between them a receiving region for receiving a portion of the length of said shaft, each said finger defining a concave indentation substantially complementary to a corner of said shaft, each finger of a pair being elastically deformable in directions toward and away from the other finger of the pair and being most stressed when said cover is at an over center point between said open and closed positions and said shaft corners are out of registry with said finger concave indentations whereby the reaction forces between said shaft and fingers thereby bias said cover toward at least one of said open and closed positions and wherein when said cover is in said closed position, said shaft corners are out of registry with said finger concave indentations.

2. A container closure which can be readily disassembled and assembled for use on a container defining an opening communicating with the container interior, said closure comprising:

a body for being mounted to said container over said container opening and defining a dispensing orifice for communicating through said container opening with said container interior;

a cover separate from said body and disposed on said body for being pivoted about an axis between a closed position occluding said dispensing orifice and an open position spaced away from said dispensing orifice;

axis-defining means on one of said cover and body for defining said axis and having a cam surface around said axis;

receiving means on the other of said cover and body for engaging said cam surface to mount said cover to said body for pivoting about said axis, at least one of said axis-defining means and said receiving means being elastically deformable and being most stressed when said cover is at an over center point between said open and closed positions to thereby bias said cover toward at least one of said open and closed positions; and said cover being adapted to be biased to a self-maintained unlatched position between said closed position and an over center point, in which said cover is adapted to be latched to said body at said closed position, in which said receiving means is elastically deformable, in which said deformable receiving means is less stressed at said unlatched position and is more stressed at said closed position, in which said cover includes a first snap-fit part, and in which said body includes a second snap-fit part for being engaged by said first snap-fit part in a snap-fit interlock when said cover is in said latched closed position.

3. The container closure in accordance with claim 1. in which said fingers are unitary with said body; and in which said shaft is unitary with said cover.

4. The container closure in accordance with claim 1 in which said fingers are unitary with said cover; and in which said shaft is unitary with said body.

5. A container closure which can be readily disassembled and assembled for use on a container defining an opening communicating with the container interior, said closure comprising:

a body for being mounted to said container over said container opening and defining a dispensing orifice for communicating through said container opening with said container interior;

a cover separate from said body and disposed on said body for being pivoted about an axis between a closed position occluding said dispensing orifice and at least one open position spaced away from said dispensing orifice;

said cover having a cam surface around said axis;

said body having a portion defining a receiving surface for being engaged by said cam surface and for receiving said cam surface, said body portion being elastically deformable from a less stressed orientation to a more stressed orientation, said deformable body portion having said less stressed orientation when said cover is in said one open position; and said cover being adapted to be biased to a self-maintained unlatched stable position between said closed position and one of said open positions and is adapted to be latched to said body at said closed position, said deformable receiving portion also having said less stressed orientation when said cover is in said unlatched stable position and being more stressed when said cover is in said closed position, said cover including a first snap-fit part, and said body including a second snap-fit part for being engaged by said first snap-fit part in a snap-fit interlock when said cover is in said latched closed position.

6. A container closure which can be readily disassembled and assembled for use on a container defining an opening communicating with the container interior, said closure comprising:

a body for being mounted to said container over said container opening and defining a dispensing orifice for communicating through said container opening with said container interior, said body including two spaced-apart wall portions each having a receiving surface defining a cavity with an opening configuration generally in the shape of a tetrahedron with a rounded vertex and rounded edges, each said wall portion cavity being oriented to face the other cavity, each said body wall portion being elastically deformable away from the other body wall portion;

a cover separate from said body and disposed on said body for being pivoted about an axis between a closed position occluding said dispensing orifice and an open position spaced away from said dispensing orifice, said cover including two spaced-apart convex cam surfaces around said axis, each said convex cam surface being oriented to face away from the other cam surface, each said convex cam surface having a configuration generally in the shape of a tetrahedron with a rounded vertex and rounded edges substantially complementary to said cavity configuration and being adapted to be received in one of said cavities; and each said elastically deformable body wall portion being most stressed when said cover is at an over center point between said open and closed positions to thereby bias said cover toward one of said open and closed positions.

7. The container closure in accordance with claim 6 in which each said body wall portion includes a cylindrical journal bearing around the opening of said cavity;

said cover includes two cylindrical projections for each being disposed within one of said cylindrical journal bearings; and each said convex cam surface extends outwardly from an end of one of said cylindrical projections.

8. A container closure which can be readily disassembled and assembled for use on a container defining an opening communicating with the container interior, said closure comprising:

a body separate from said cover and for being mounted to said container over said container opening and defining a dispensing orifice for communicating through said container opening with said container interior, said body including two spaced-apart wall portions defining convex cam surfaces around an axis, each said convex cam surface being oriented to face away from the other cam surface, each said convex cam surface having a configuration generally in the shape of a tetrahedron with a rounded vertex and rounded edges, each said body wall portion being elastically deformable toward the other body wall portion;

a cover separate from said body and disposed on said body for being pivoted about said axis between a closed position occluding said dispensing orifice and an open position spaced away from said dispensing orifice, said cover including a receiving surface defining a cavity with an opening configuration generally in the shape of a tetrahedron with a rounded vertex and rounded edges, each said cavity being oriented to face the other cavity, each said cavity being substantially complementary to said convex cam surface configuration and being adapted to engage one of said cam surfaces; and each said elastically deformable body wall portion being most stressed when said cover is at an over center point between said open and closed positions to thereby bias said cover toward one of said open and closed positions.

9. The container closure in accordance with claim 8 in which each said cover includes a cylindrical journal bearing at the bottom of one of said cavities;

said body wall portions each includes a cylindrical projection for each being disposed within one of said cylindrical journal bearings; and each said cylindrical projection extends outwardly from one of said convex cam surfaces.

* * * * *